US011484071B2

(12) United States Patent
Capotosto

(10) Patent No.: US 11,484,071 B2
(45) Date of Patent: Nov. 1, 2022

(54) FACE MASK

(71) Applicant: DAC3D, INC., Biddeford, ME (US)

(72) Inventor: David A. Capotosto, Biddeford, ME (US)

(73) Assignee: DAC3D, INC., Biddeford, ME (US)

( * ) Notice: Subject to any disclaimer, the term of this patent is extended or adjusted under 35 U.S.C. 154(b) by 222 days.

(21) Appl. No.: 17/083,717

(22) Filed: Oct. 29, 2020

(65) Prior Publication Data

US 2021/0307420 A1 Oct. 7, 2021

Related U.S. Application Data

(60) Provisional application No. 63/003,759, filed on Apr. 1, 2020.

(51) Int. Cl.
*A41D 13/11* (2006.01)

(52) U.S. Cl.
CPC ..... *A41D 13/1161* (2013.01)

(58) Field of Classification Search
CPC ..... A41D 13/11–1192; A62B 18/00; A62B 18/02; A62B 18/025; A62B 18/08; A62B 18/084; A62B 23/00–04
See application file for complete search history.

(56) References Cited

U.S. PATENT DOCUMENTS

| | | | |
|---|---|---|---|
| 1,587,643 | A | 6/1926 | Harman |
| 4,635,628 | A | 1/1987 | Hubbard et al. |
| 4,790,370 | A | 12/1988 | Haber et al. |
| 4,802,473 | A | 2/1989 | Hubbard et al. |
| 5,107,547 | A | 4/1992 | Scheu |
| 5,842,470 | A | 12/1998 | Ruben |
| D471,537 | S | 3/2003 | Ham |
| D585,881 | S | 2/2009 | Nam et al. |
| 7,664,287 | B2 | 2/2010 | Neu et al. |
| 2005/0103344 | A1 | 5/2005 | Cheng |
| 2010/0124349 | A1 | 5/2010 | Bass |
| 2012/0125343 | A1 | 5/2012 | Tai |

FOREIGN PATENT DOCUMENTS

| | | | |
|---|---|---|---|
| DE | 202020102269 U1 | * | 6/2020 |
| KR | 20090017711 A | * | 2/2009 |
| KR | 20160125733 A | * | 11/2016 |

* cited by examiner

*Primary Examiner* — Michelle J Lee

(74) *Attorney, Agent, or Firm* — Tredecim LLC; Sean L. Sweeney

(57) ABSTRACT

Disclosed herein are novel face masks utilizing a first earpiece having a trap and an ear loop, a second earpiece having a trap and an ear loop, and a protective sheet routed through the trap of the first earpiece and the trap of the second earpiece such that the protective sheet is removably connected to the first earpiece and the second earpiece, where the ear loop of the first earpiece is positioned to surround a first ear of a user and the ear loop of the second earpiece is positioned to surround a second ear of the user such that the protective sheet covers the user's nose and mouth.

16 Claims, 12 Drawing Sheets

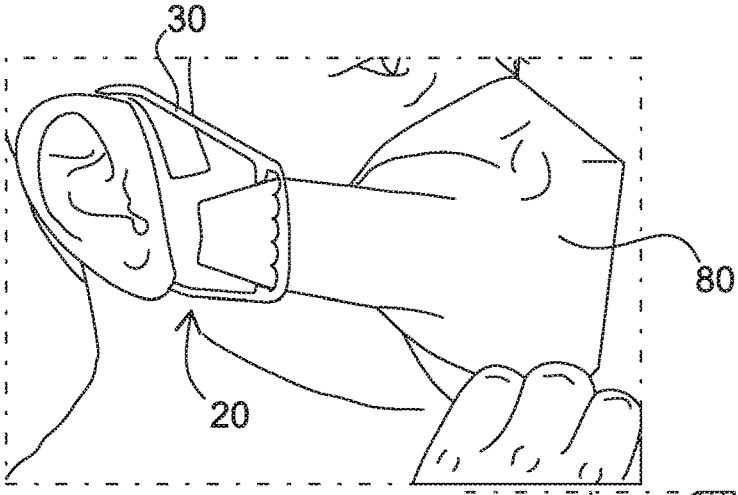
FIG. 17
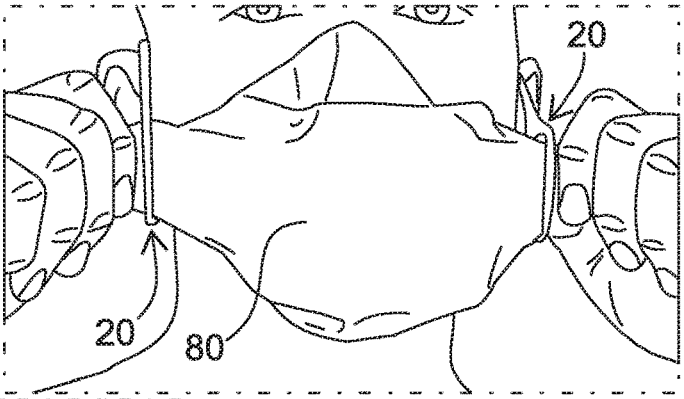
FIG. 18
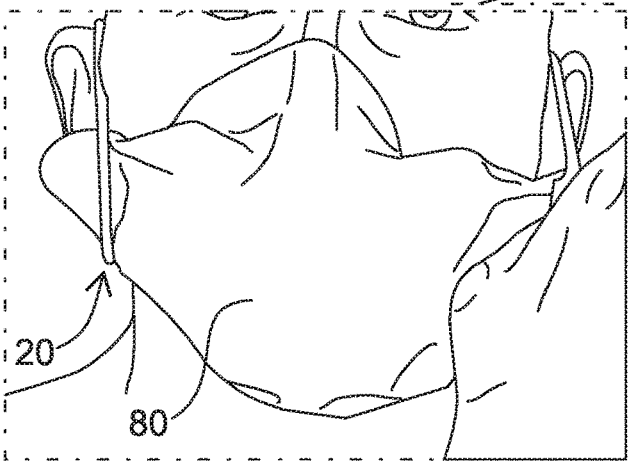
FIG. 19
FIG. 20
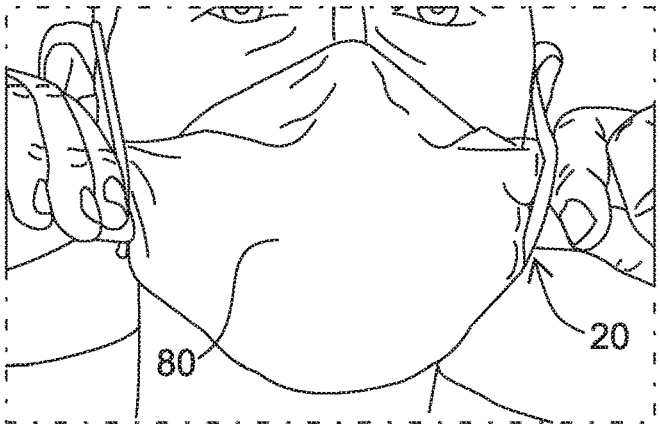

FACE MASK

BACKGROUND

Field of the Invention

The present invention pertains to the field of personal protective equipment. Specifically, this invention relates to a novel face mask, worn over the nose, mouth, chin and portions of the cheeks to reduce the transmission of infection, that allows users to easily attach replaceable protective sheets to reusable earpieces.

Although existing designs for disposable face masks are relatively inexpensive, these products utilize designs that are elaborate in comparison to their cost and traditionally requiring a fair amount of material cutting and sewing. In addition, traditional face masks can be extremely uncomfortable for the user when worn for any substantial length of time. For example, traditional elastic ear loops can dig into the skin surrounding the user's ears, irritating and sometimes even breaking through the skin.

While other face masks have been proposed, none of these inventions, taken either singly or in combination, adequately address or resolve the aforementioned problems. Therefore, a need exists for a comfortable, low-cost, easy to manufacture face mask design that attaches a protective sheet to a pair of earpieces to provide a comfortable, low-cost, easy to manufacture on streamlined manufacturing processes.

SUMMARY OF THE INVENTION

The present invention solves the problems associated with extended use of face masks and provides a face mask where a replaceable protective sheet is attached to reusable earpieces.

The present invention is directed to a face mask. The face mask comprises a first earpiece having a trap and an ear loop; a second earpiece having a trap and an ear loop; and a protective sheet routed through the trap of the first earpiece and the trap of the second earpiece such that the protective sheet is removably connected to the first earpiece and the second earpiece, wherein the ear loop of the first earpiece is positioned to surround a first ear of a user and the ear loop of the second earpiece is positioned to surround a second ear of the user such that the protective sheet covers the user's nose and mouth.

In addition, the present invention is directed to a face mask that comprises a first earpiece having a trap and an attachment point; a second earpiece having a trap and an attachment point; a band attaching the attachment point of the first earpiece to the attachment point of the second earpiece; and a protective sheet routed through the trap of the first earpiece and the trap of the second earpiece such that the protective sheet is removably connected to the first earpiece and the second earpiece, wherein the first earpiece is positioned adjacent to a first ear of a user and the second earpiece is positioned adjacent to a second ear of the user such that the band extends behind the user's head and the protective sheet covers the user's nose and mouth.

In addition, the present invention is directed to a method for applying and wearing a face mask. First, the method comprises providing a face mask comprising a first earpiece having a trap and an ear loop; a second earpiece having a trap and an ear loop; and a protective sheet routed through the trap of the first earpiece and the trap of the second earpiece such that the protective sheet is removably connected to the first earpiece and the second earpiece, wherein the ear loop of the first earpiece is positioned to surround a first ear of a user and the ear loop of the second earpiece is positioned to surround a second ear of the user such that the protective sheet covers a nose, mouth, and chin of the user. A second step involves securing the protective sheet in the trap of the first earpiece. A third step involves securing the protective sheet in the trap of the second earpiece. A fourth step involves positioning the first earpiece around a first ear of a user. A fifth step involves positioning the second earpiece around a second ear of the user. A sixth step involves adjusting the protective sheet to cover the user's nose and mouth. A seventh step involves tightening the protective sheet by pulling the protective sheet through the trap of the trap of the first earpiece, the trap of the second earpiece, or the trap of both the first and second earpiece such that the protective sheet is fitted across the user's face.

BRIEF DESCRIPTION OF THE DRAWINGS

These and other features, aspects and advantages of the present invention will become better understood with reference to the following description, appended claims, and accompanying drawings where:

FIG. 17 is a front view of an embodiment of a face mask of the present invention being adjusted to conform to the face of the user.

FIG. 18 is a front view of an embodiment of a face mask of the present invention being tightened by adjusting both ends of the protective sheet.

FIG. 19 is a front view of an embodiment of a face mask of the present invention being tightened by adjusting one end of the protective sheet FIG. 20 is a front view of an embodiment of a face mask of the present invention being adjusted to tuck the ends of the protective sheet under the earpieces.

DETAILED DESCRIPTION OF THE INVENTION

Figure 1:
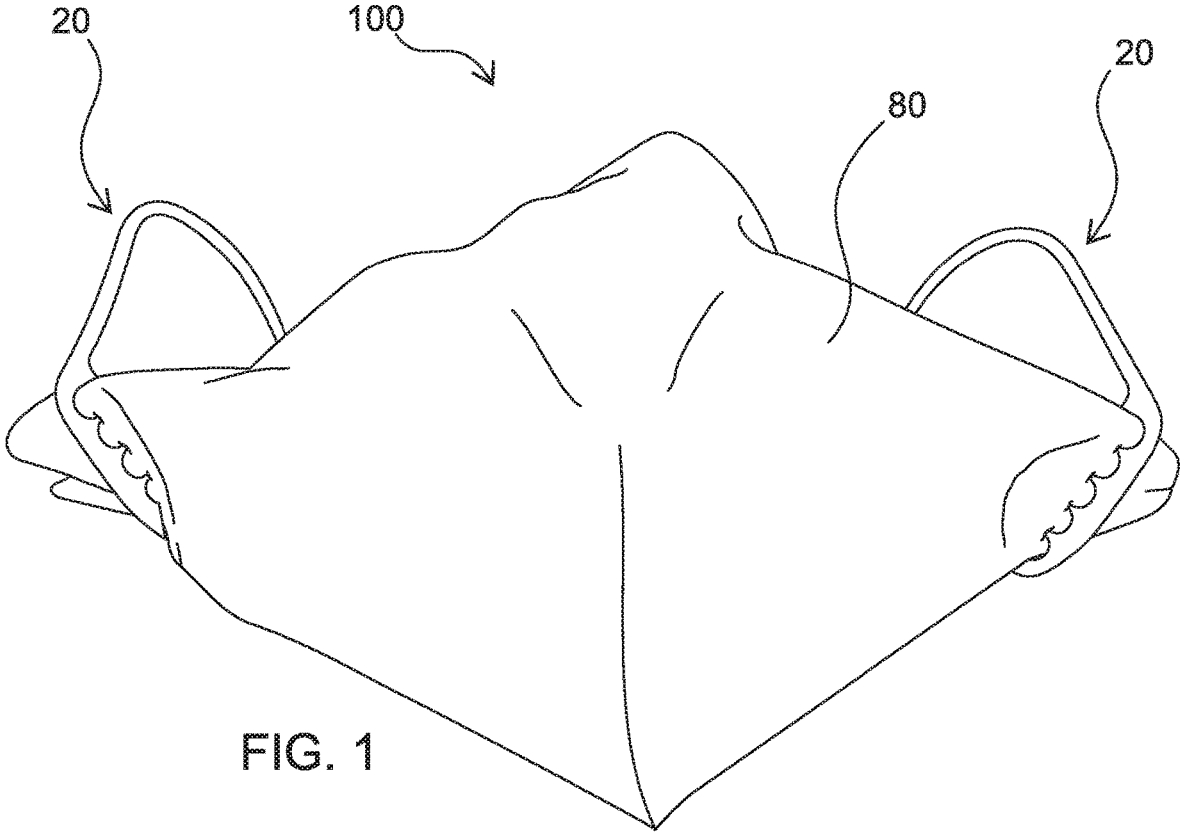
FIG. 1 is a front view of an embodiment of a face mask of the present invention.
Figure 2:
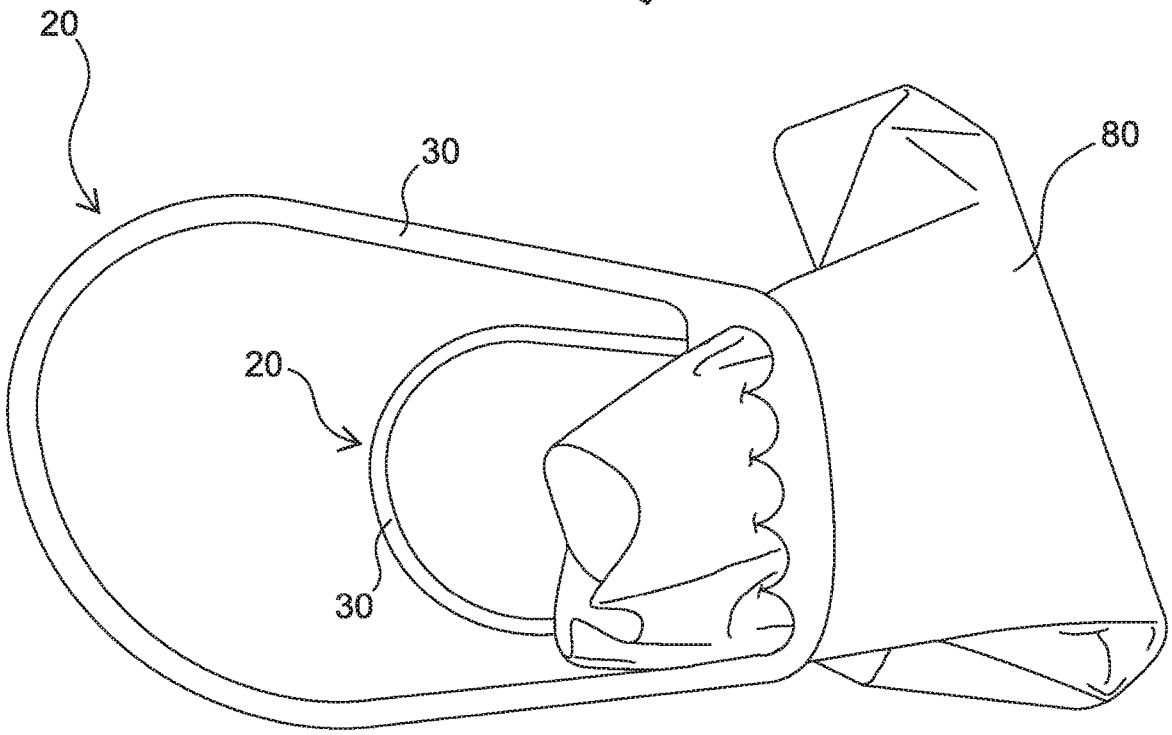
FIG. 2 is a side view of an embodiment of a face mask of the present invention.
Figure 3:
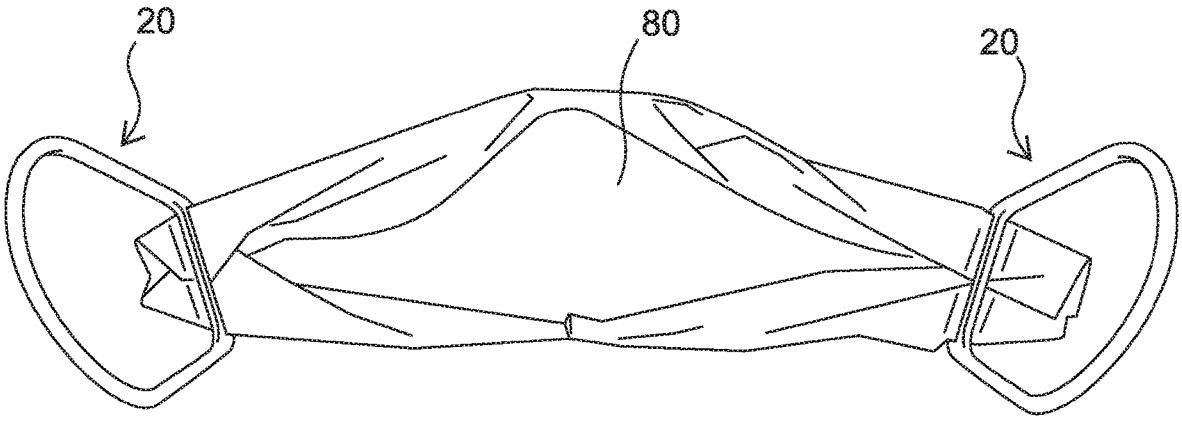
FIG. 3 is a back view of an embodiment of a face mask of the present invention.
Figure 4:
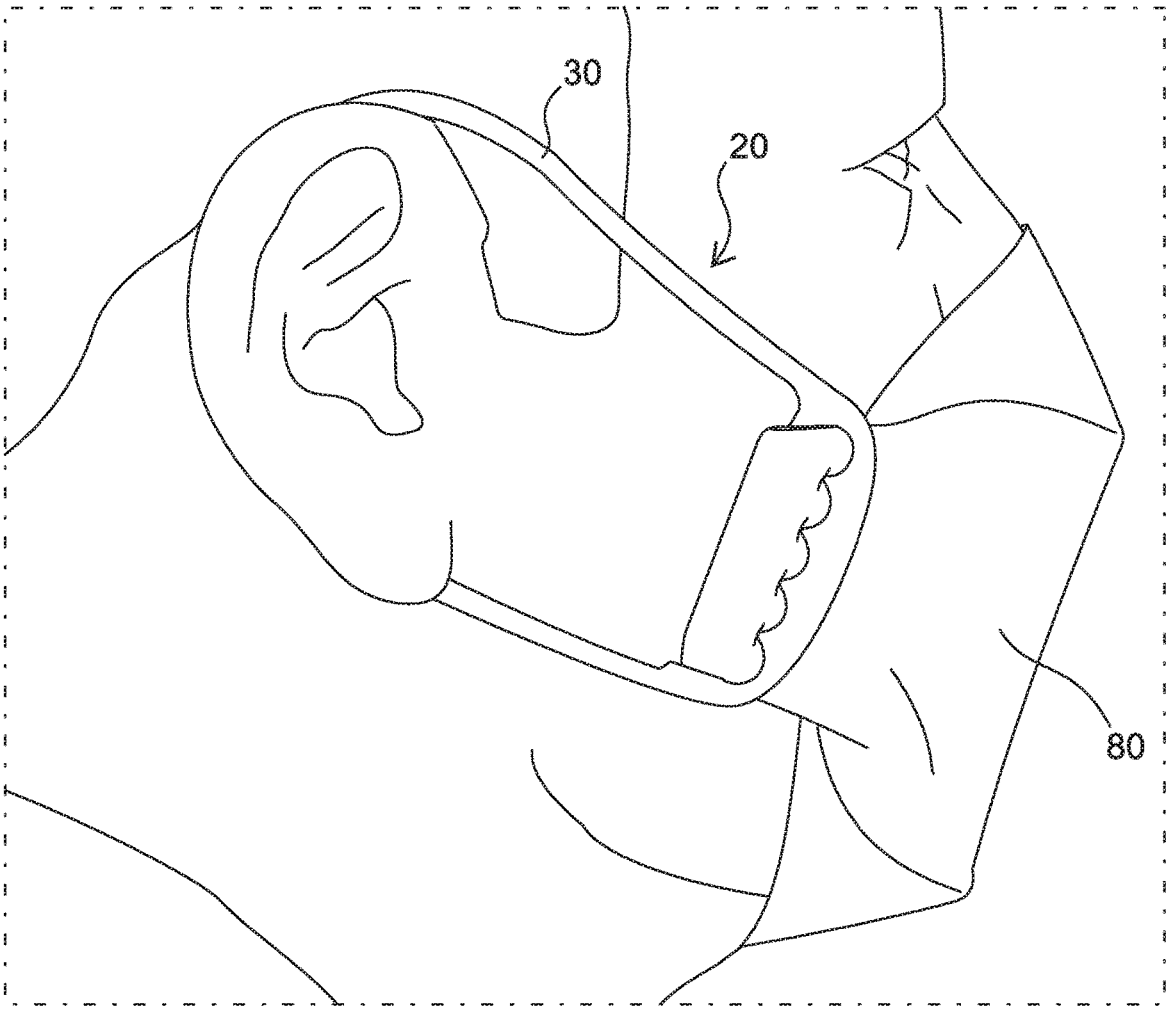
FIG. 4 is a side view of an embodiment of a face mask of the present invention.

The present invention is directed to the problems associated with extended use and reuse of disposable face masks. Specifically, the present invention provides a face mask that allows users to attach replaceable protective sheets to reusable earpieces. Face masks of the present invention can be worn over the nose, mouth, chin and portions of the cheeks to reduce the transmission of infection.

Turning to FIGS. 1 through 4, a face mask 100 of the present invention is shown. The face mask 100 includes a first earpiece 20 and a second earpiece 20 (collectively, the earpieces 20), and a protective sheet 80. The earpieces 20 may be constructed of any pliable material known in the art, such as silicon, rubber, plastic, or any combination thereof. In preferred embodiments, the earpieces 20 may be constructed of material that is flexible to allow for easy positioning of the earpieces 20 around the user's ears, yet sufficiently rigid to ensure that the protective sheet 80 remains attached to the earpieces 20 while being worn by the user. The first earpiece 20 and the second earpiece 20 may be identical such that either earpiece 20 can go on either ear. Alternatively, the first earpiece 20 and the second earpiece 20 may be shaped such that one earpiece 20 is designed for the user's right ear and one earpiece 20 is designed for the user's left ear.

Turning to FIGS. 5 and 5*a* through 5*h*, multiple embodiments of the earpieces 20 of the present invention are shown. The earpieces 20 each include a trap portion 25, which includes a trap 40, and an ear loop 30. The ear loop 30 extends from the trap portion 25, forming a loop that can wrap around the user's ear and secure the earpiece 20 to the user's head. In exemplary embodiments, the ear loop 30 is a closed loop as depicted in FIGS. 5*a* through 5*h*. In these embodiments, the earpiece 20 is secured by placing the ear loop 30 around the user's ear. In alternative embodiments, the ear loop 30 may be open such that the ear loop 30 hooks over the top of the user's ear and terminates at some point behind the ear. When the face mask 100 is in use, the earpiece 20 is positioned such that the ear loop 30 secures the earpiece 20 to the user's ear and the trap portion 25 is positioned toward the users' face.

The protective sheet 80 is routed through the trap 40 to secure the protective sheet 80 to the earpiece 20. Once the protective sheet 80 is secured by the trap 40, the fit of the face mask 100 can be adjusted by pulling the protective sheet 80 further through the trap 40.

The trap 40 may be any tension or friction fit trap known in the art. In some embodiments, the trap 40 may be linear. A linear trap, such as the linear trap 40 depicted in FIG. 5, includes a substantially linear aperture 42 formed between a front support 50 and a rear support 70, where the front support 50 includes a plurality of teeth 52 that extend toward the rear support 70. The size of the aperture 42 between the front support 50 and the rear support 70 and the size and shape of the teeth 52 may vary. For example, the linear aperture 42 may be narrower in embodiments where a thinner protective sheet 80 will be used or the linear aperture 42 may be thicker in embodiments where multi-layer protective sheets 80 will be used. In addition, the size of the teeth 52 may be adapted to adjust to the size of the linear aperture 42 and the degree to which the teeth 52 engage the protective sheet 80. Similarly, the shape of the teeth 52 may be adapted to increase or decrease the degree to which the teeth 52 engage the protective sheet 80.

In some embodiments, there may be a plurality of linear traps 40. For example, in FIG. 5*b*, a first linear trap 40*b* is depicted having a front support 50*b* and a central support 60*b*, where the front support 50*b* includes a plurality of teeth 52*b* that extend toward the central support 60*b*. In addition, a second linear trap 40*b* is formed by the central support 60*b* and a rear support 70*b*, where the central support 60*b* includes a plurality of teeth 62*b* that extend toward the rear support 70*b*.

Figure 5:
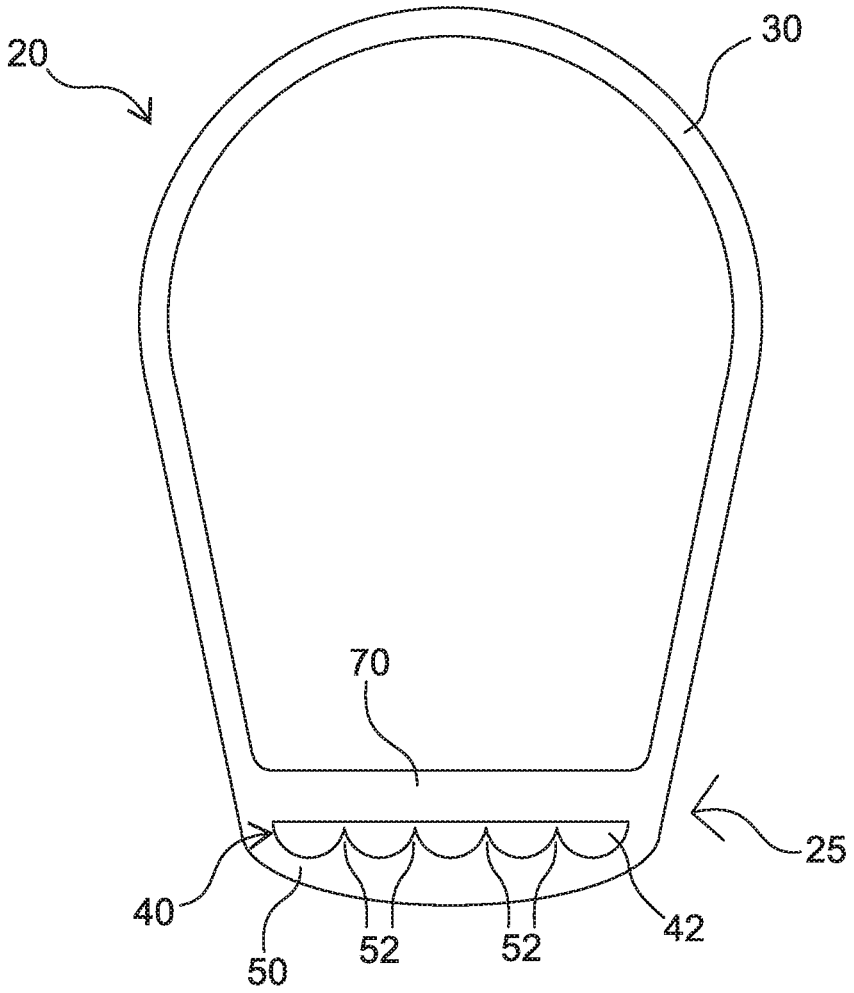
FIG. 5 is a top view of an embodiment of an earpiece of the present invention.
Figure 5A:
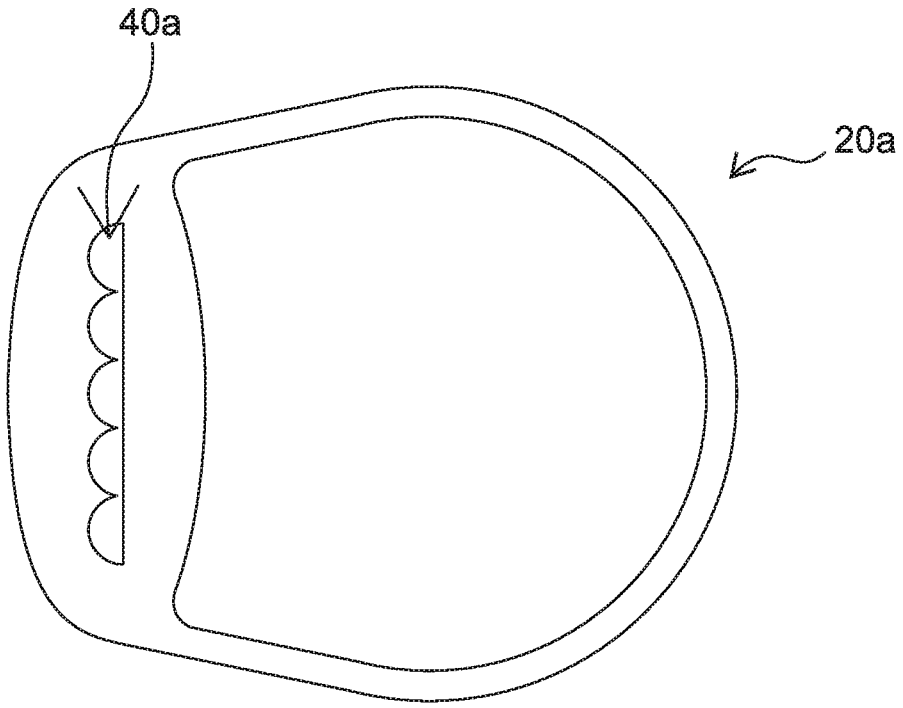
FIG. 5*a* is a top view of an embodiment of an earpiece of the present invention.
Figure 5B:
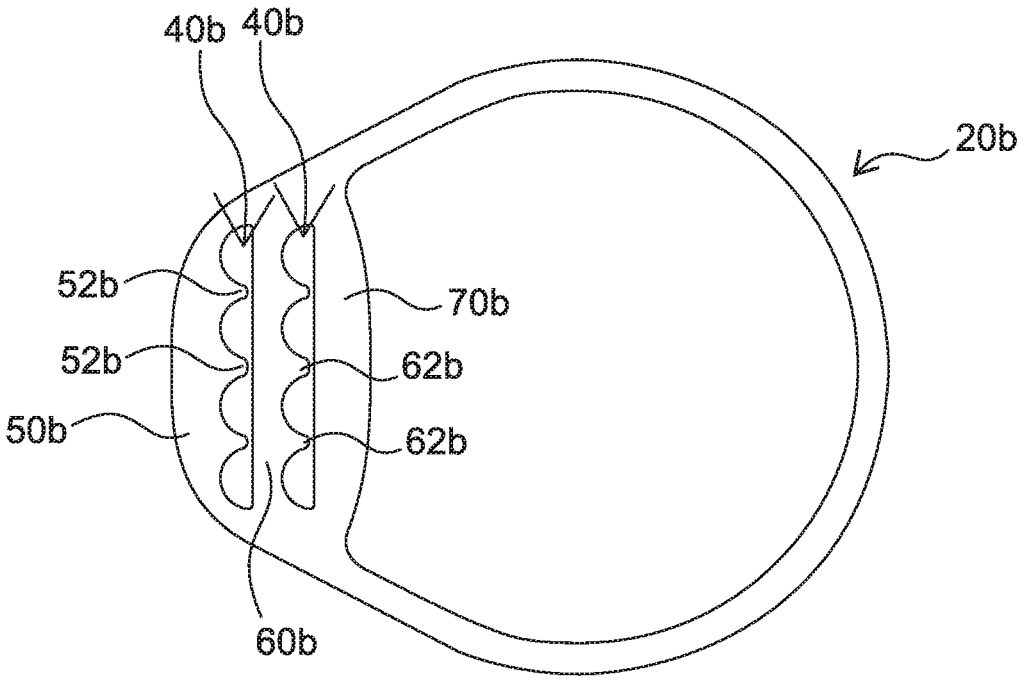
FIG. 5*b* is a top view of an embodiment of an earpiece of the present invention.
Figure 5C:
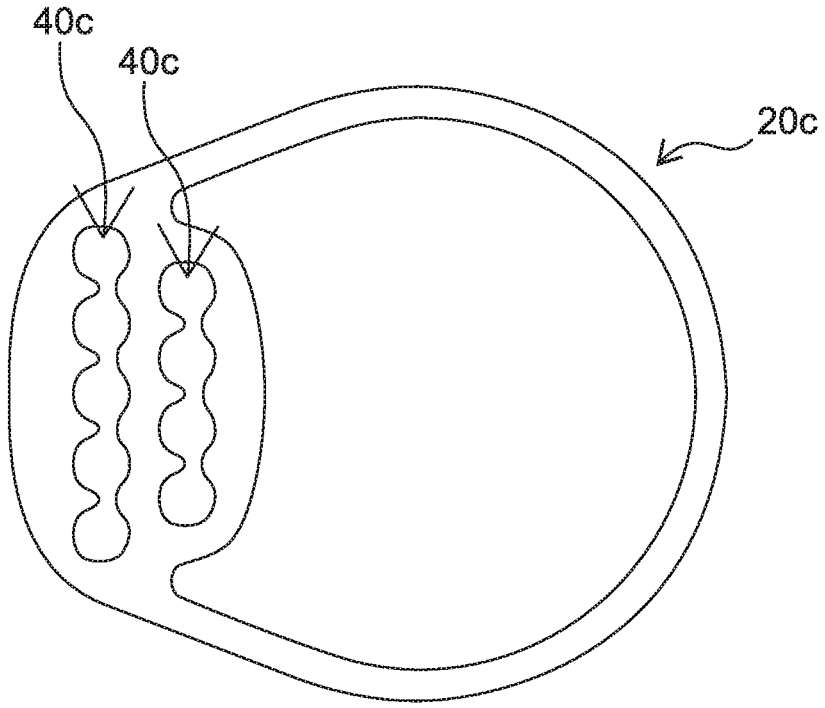
FIG. 5*c* is a top view of an embodiment of an earpiece of the present invention.
Figure 5D:
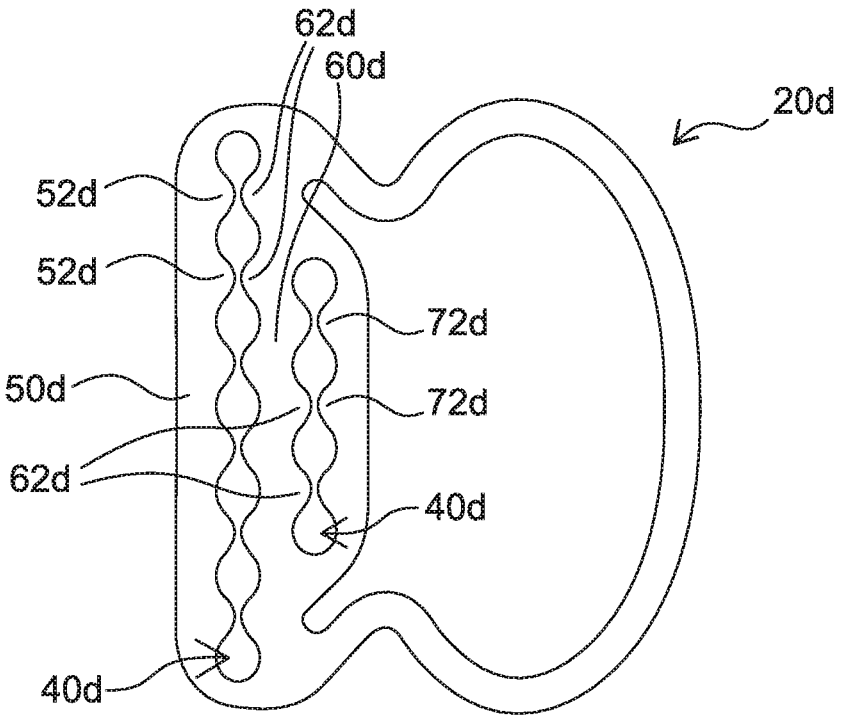
FIG. 5*d* is a top view of an embodiment of an earpiece of the present invention.
Figure 5E:
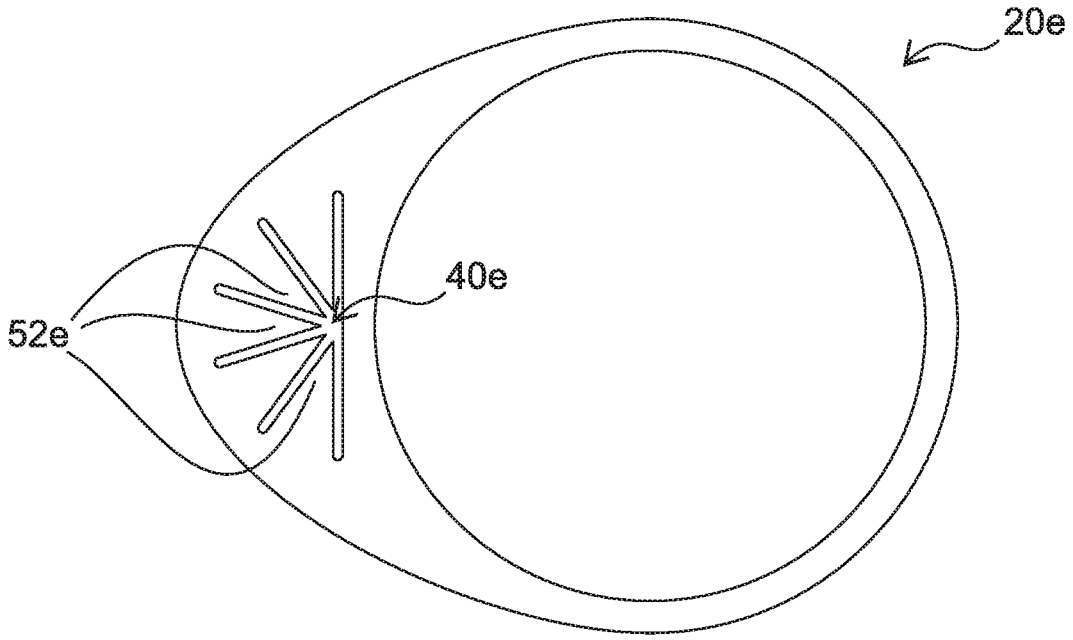
FIG. 5*e* is a top view of an embodiment of an earpiece of the present invention.
Figure 5F:
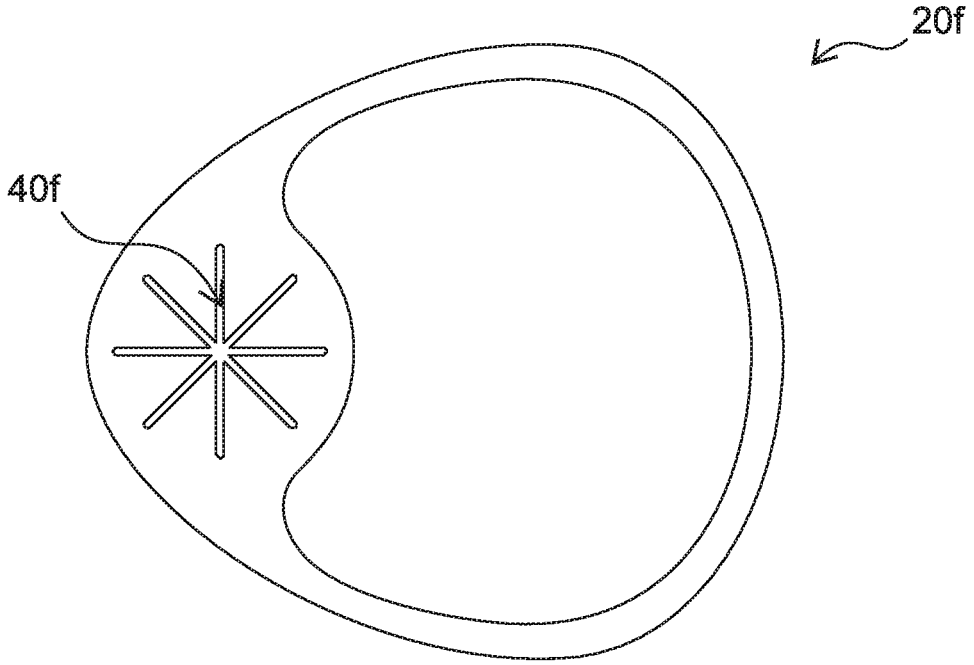
FIG. 5*f* is a top view of an embodiment of an earpiece of the present invention.

While the teeth 52 depicted in FIG. 5 are depicted as extending into the aperture 42 from only the front support 50, the teeth may extend into the aperture 42 from both sides. For example, FIG. 5*d* depicts teeth 52*d*, 62*d*, 72*d* disposed on the front support 50*b*, on both sides of the central support 60*b* and on the rear support 70*b*. Alternatively, the teeth may be omitted entirely as shown, for example, in FIG. 5*h*. Further, where teeth 52 project into the aperture 42 from both sides of the aperture, the shape and size of the teeth 52 may be substantially the same size and shape on both sides of the aperture 42, or the teeth 52 may vary such that the teeth 52 on one side of the aperture 42 are a different size and shape compared to the teeth 52 on the other side of the aperture 42. As will be understood by a person of skill in the art, varying the size and shape of the teeth 52 is an effective way to adjust both how aggressively the linear trap 40 engages the protective sheet 80 and how easily the protective sheet 80 may be routed through the trap 40.

Figure 5G:
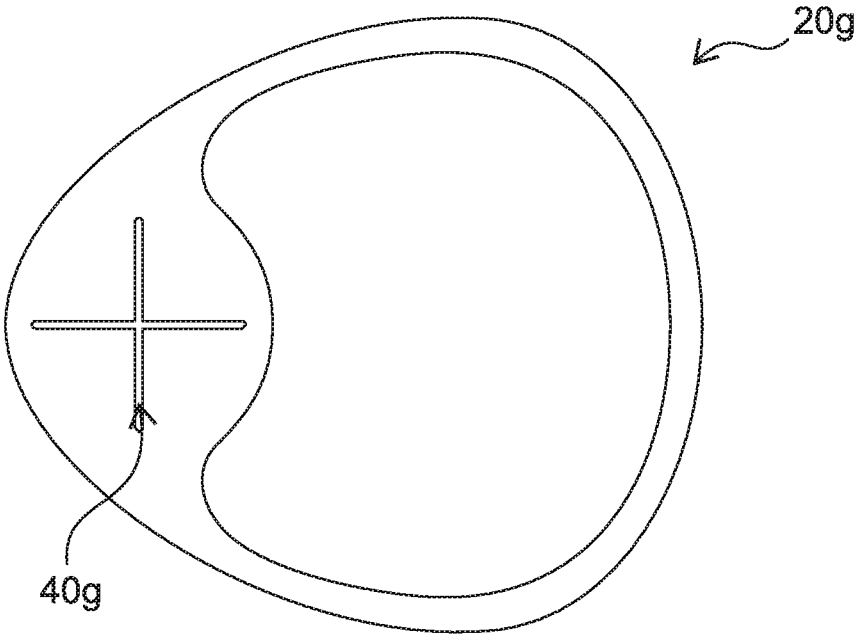
FIG. 5*g* is a top view of an embodiment of an earpiece of the present invention.
Figure 5H:
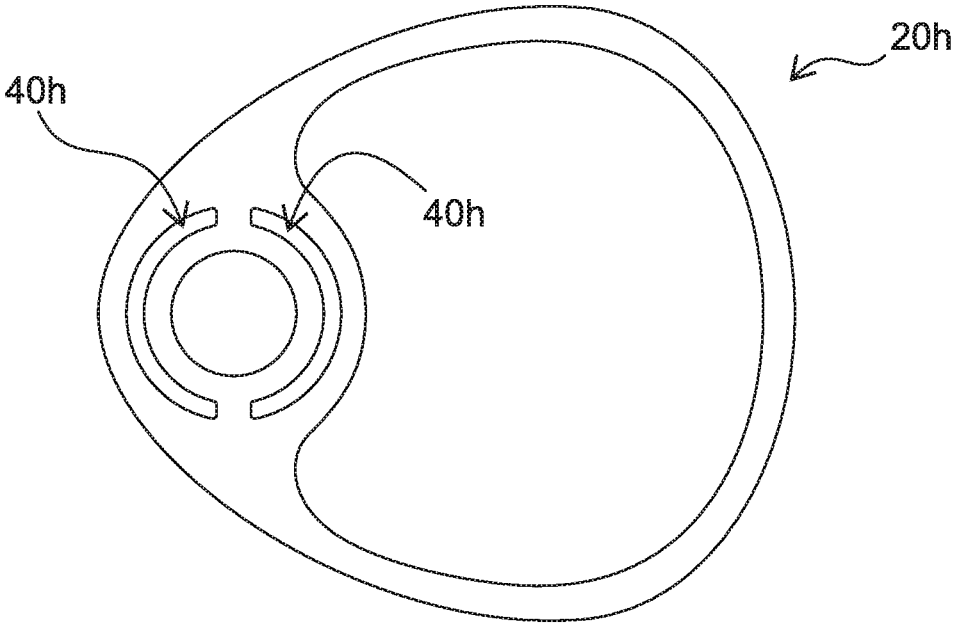
FIG. 5*h* is a top view of an embodiment of an earpiece of the present invention.

In other embodiments, the trap 40 may be an enclosed trap 40 that is formed by a plurality of cuts that define a series of teeth 52. The enclosed trap 40 depicted in FIG. 5*e* has a border that is a semicircle, with multiple relief cuts creating a set of five teeth 52*e*. However, the enclosed trap may have a border of any known shape and one or more relief cuts within the border that form teeth. For example, the enclosed trap 40 may be a circle with two orthogonal cuts that create four teeth as depicted in FIG. 5*g*. When the protective sheet 80 is routed through the enclosed trap 40, the teeth create a friction fit to secure the protective sheet 80 to the earpiece 20.

Figure 6:
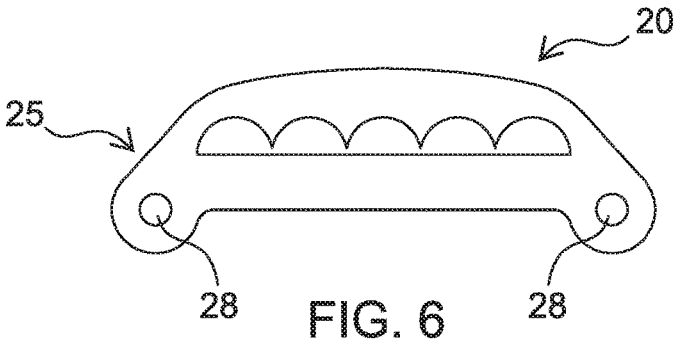
FIG. 6 is a top view of an embodiment of an earpiece of the present invention.
Figure 7:
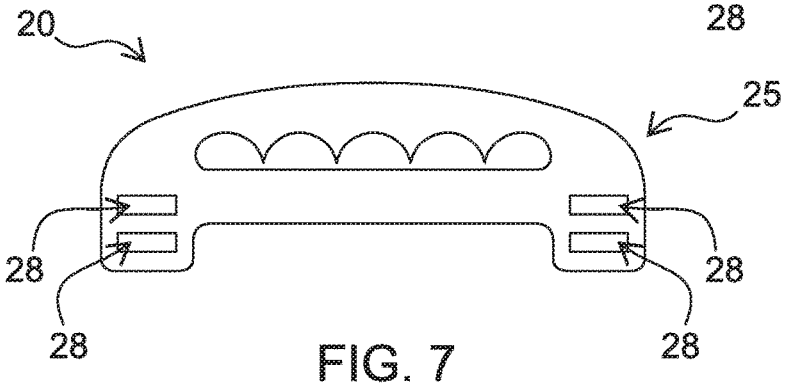
FIG. 7 is a top view of an embodiment of an earpiece of the present invention.
Figure 7A:
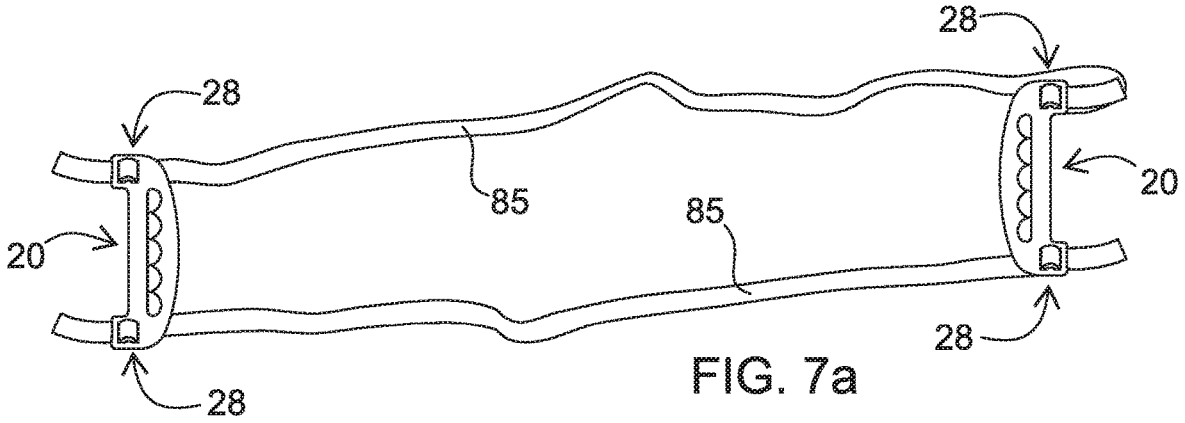
FIG. 7*a* is a top perspective view of a pair of earpieces of the present invention.
Figure 7B:
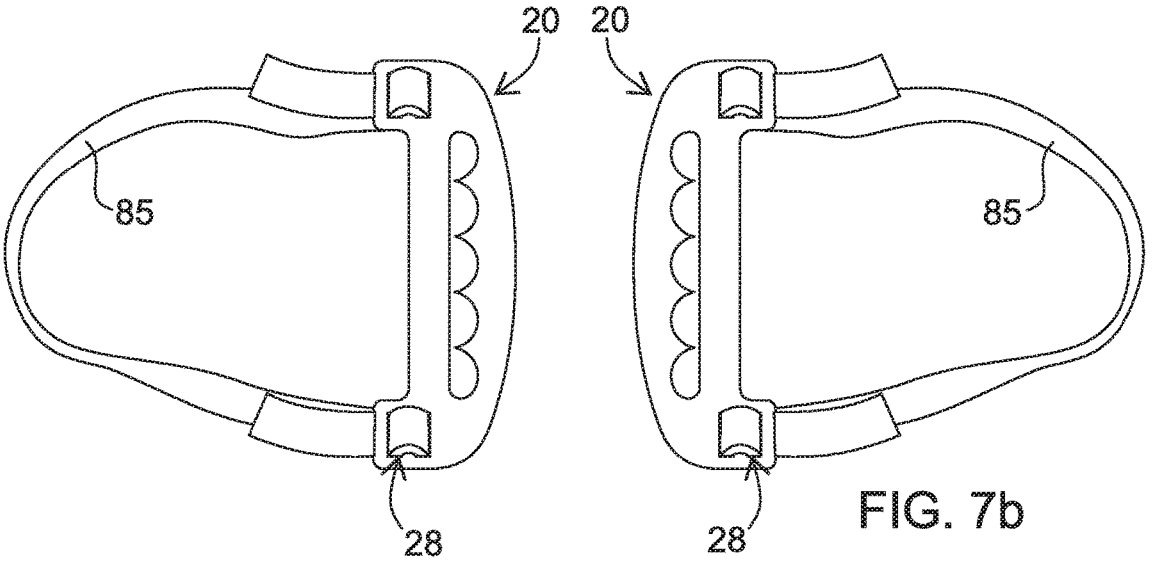
FIG. 7*b* is a top perspective view of a pair of earpieces of the present invention.

Turning to FIGS. 6, 7, 7*a* and 7*b*, additional alternative embodiments of the earpieces 20 are depicted, where the trap portion 25 of the earpiece 20 includes one or more attachment points 28. The attachment points 28 may be simple holes as depicted in FIG. 6, or the attachment points 28 may be adjustable as depicted in FIG. 7. Where the attachment points 28 are adjustable, the attachment points are analogous to the trap 40 described previously.

Where attachment points 28 are present on the earpiece 20, a band 85 may be connected to each of the connection points 28 on a single earpiece 20 as depicted in FIG. 7*a*. In this configuration, the band 85 functions in a manner similar to the ear loops 30 described above. Alternatively, one or more bands 85 may be used to attach to the trap portion 25 of a first earpiece 20 to the trap portion 25 of a second earpiece 20 as depicted in FIG. 7*b*. In this configuration, the earpieces 20 can be secured to the user's head by positioning the band 85 behind the user's head, such that the tension created by the band 85 secures the face mask 100 in place when the protective sheet 80 is attached to the earpieces 20.

The protective sheet 80 is the portion of the face mask 100 that covers the user's nose, mouth, chin and portions of the cheeks. The protective sheet 80 may be any shape capable of covering the user's nose, mouth, chin and portions of the user's cheeks. In some embodiments, the protective sheet 80 is a rectangle. Similarly, the protective sheet 80 may be any size capable of covering the user's nose, mouth, chin and portions of the cheeks.

The protective sheet 80 may be any material including cotton, wood pulp, nylon, polyester, polypropylene or a blend of these materials and may be produced as either a woven, non-woven or knitted product. In some embodiments, the protective sheet 80 may be a microfiber cloth. In some embodiments, the protective sheet 80 may be produced by hydro-entangling, spunbonding or melt blowing, and may include pin welding or edge sealing. In addition, the protective sheet 80 may also be laundered or sterilized. The protective sheet 80 may be engineered to have characteristics such as low particulate counts, high filtration efficiency, good breathability, fire retardancy and low moisture absorbency.

Depending on the intended use of the face mask 100, the protective sheet 80 material may vary. For example, where the face mask 100 is intended to act only as a simple physical barrier, the protective sheet 80 material may have lower fluid resistance and lower filtration efficiency. Conversely, where the face mask 100 is intended to be used around people with airborne diseases, the protective sheet 80 material may have higher fluid resistance and higher filtration efficiency. Additionally, where the face mask 100 is intended to be worn for fashion purposes, the protective sheet 80 material may be any woven or non-woven material.

Figure 8:
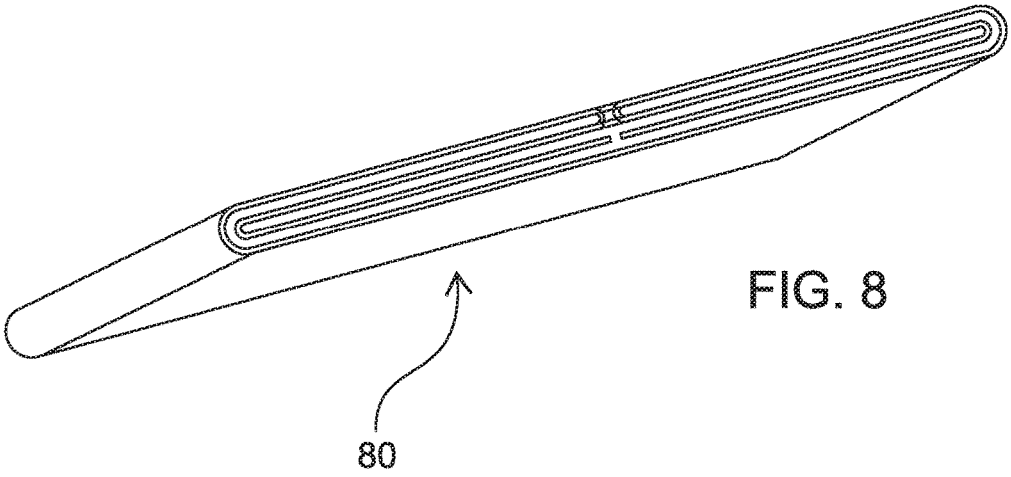
FIG. 8 is a perspective view of an exemplar folding pattern for a protective sheet of the present invention.

The protective sheet 80 may be made of a cut sheet or a cut and folded sheet. For example, the protective sheet 80 may be knife cut, die cut, or machine CNC cut. In embodiments where the protective sheet 80 is made of a folded sheet, the protective sheet 80 may be folded in any way known in the art. An exemplar folding pattern for the protective sheet (80) is shown in FIG. 8. The protective sheet 80 may be a single layer or multiple layers. In addition, where the protective sheet 80 is comprised of multiple layers, the protective sheet 80 may be comprised of multiple layers of the same material or the protective sheet 80 may be comprised of individual layers of differing materials. For example, the protective sheet may utilize an outer layer that has a higher fluid resistance, while one or more inner layers may be made of separate materials that possess higher filtration rates, but a lower fluid resistance. Where the protective sheet 80 includes more than one layer, some of the layers may extend the whole length of the protective sheet 80, while other layers may be sized and shaped to cover a portion of the user's face. The additional layers may stacked in a desired configuration prior to folding or the additional layers may be placed within a fold in the protective sheet 80. In some embodiments where the protective sheet 80 is comprised of multiple layers, the layers may be connected to form a single protective sheet with sealed edges. Where the protective sheet 80 is sealed, it may be sealed using any methods known in the art, including but not limited to sewn, stapled, or ultrasonically or heat welded. The multiple layers of protective sheet 80 may comprise an outer layer and an inner layer that each has a high fluid resistance and a high filtration central layer positioned between the outer layer and the inner layer. Further, the outer layer and the inner layer of the protective sheet 80 may each be meltblown and the central layer may be spunbond.

In some embodiments, the face mask 100 may include deformable reinforcement in the nose and chin areas. For example, the face mask 100 may include one or more clips for use on the user's nose, chin, or both, to increase the efficacy of the face mask. These clips may be made of any suitable material that is capable of being deformed and retaining its deformed shape. The clips may be applied to the protective sheet 80 externally, adhering to the user's face using a tension fit, the clips may be sealed or otherwise integrated into the protective sheet 80, or the clips may be inserted into the protective sheet 80, for example either within a fold or within a layer. In addition, Alternatively, foam may be utilized in connection with the protective sheet 80 to improve the seal between the protective sheet 80 and the user's face.

Figure 9:
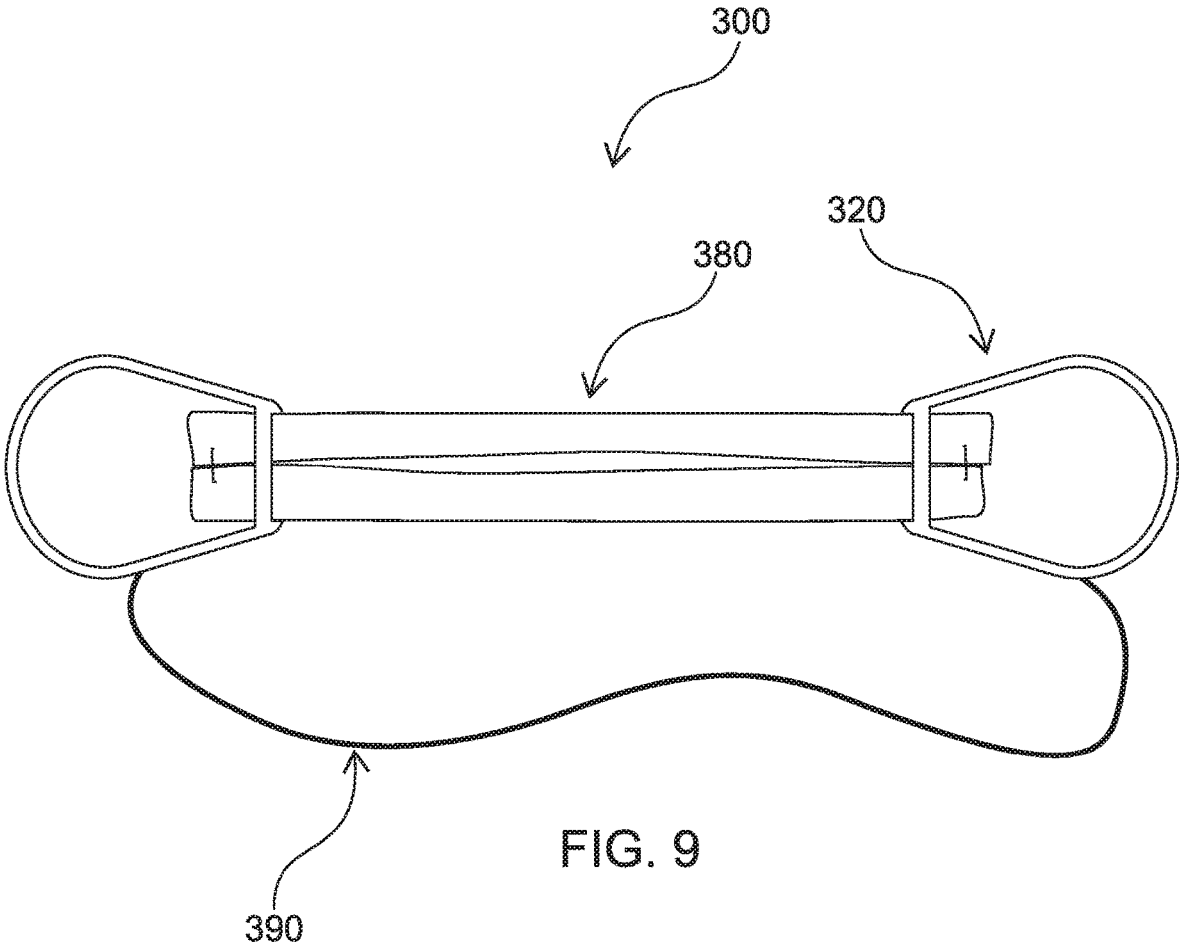
FIG. 9 is a top view of an embodiment of a face mask of the present invention.
Figure 10:
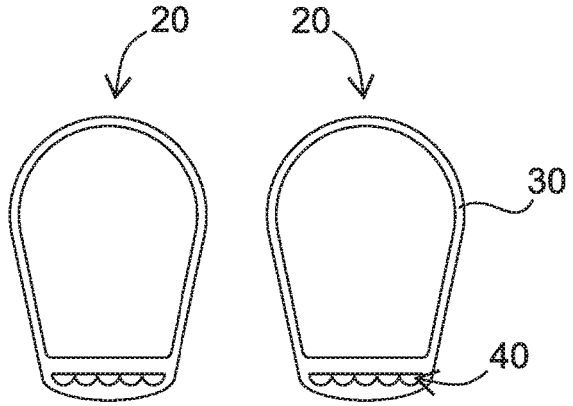
FIG. 10 is a top view of an embodiment of a pair of earpieces of the present invention.
Figure 11:
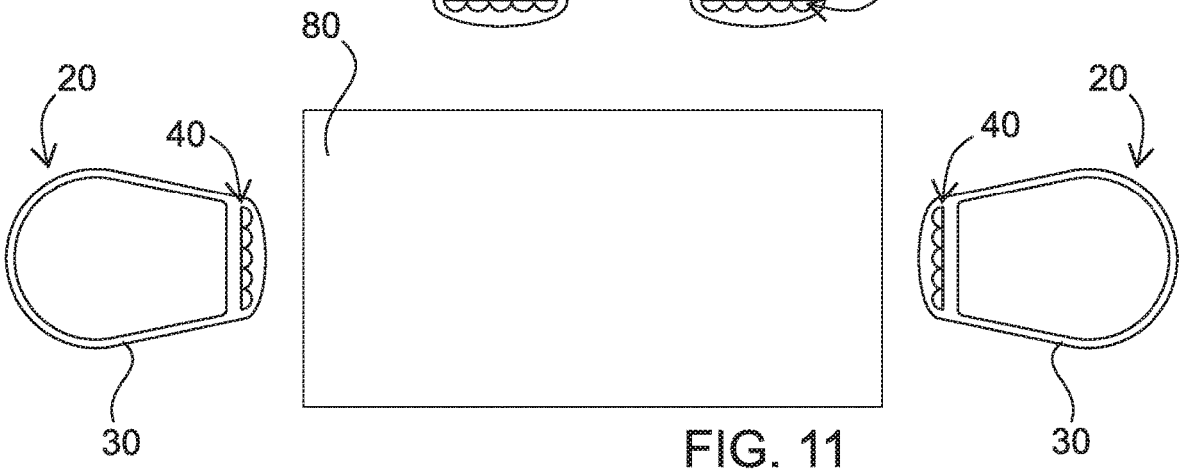
FIG. 11 is a front view of the components of an embodiment of a face mask of the present invention.
Figure 12:
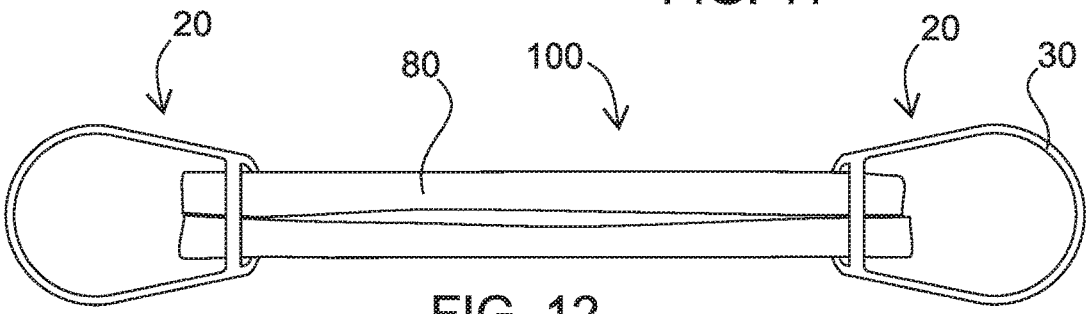
FIG. 12 is a top view of an embodiment of a face mask of the present invention.
Figure 13:
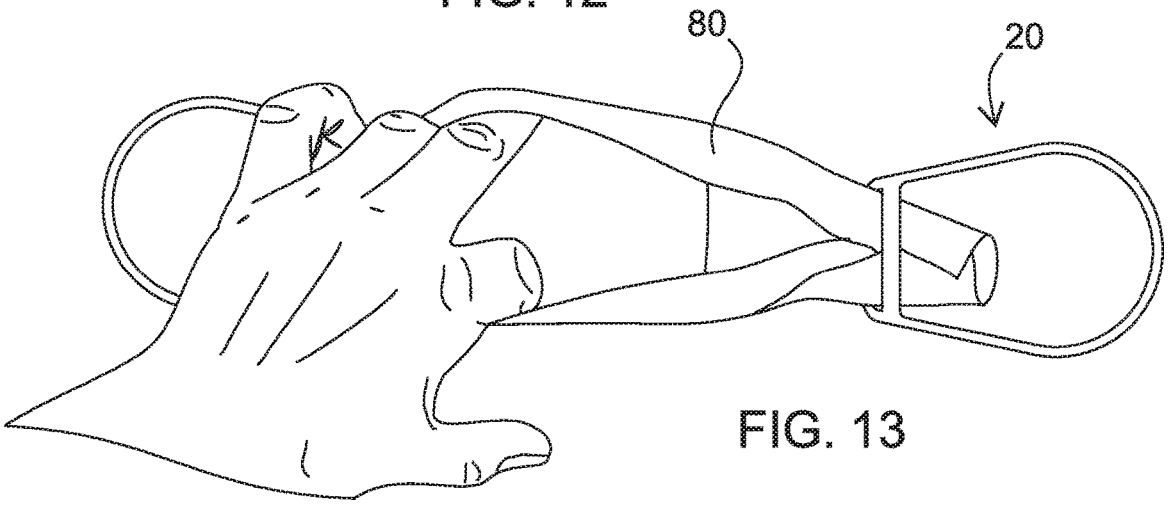
FIG. 13 is a top perspective view of an embodiment of a face mask of the present invention.
Figure 14:
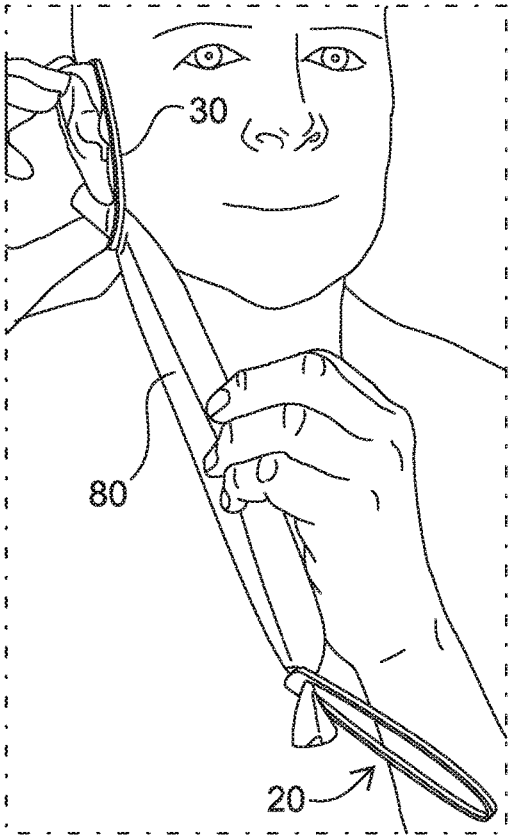
FIG. 14 is a front view of an embodiment of a face mask of the present invention being positioned on one ear of a user.
Figure 15:
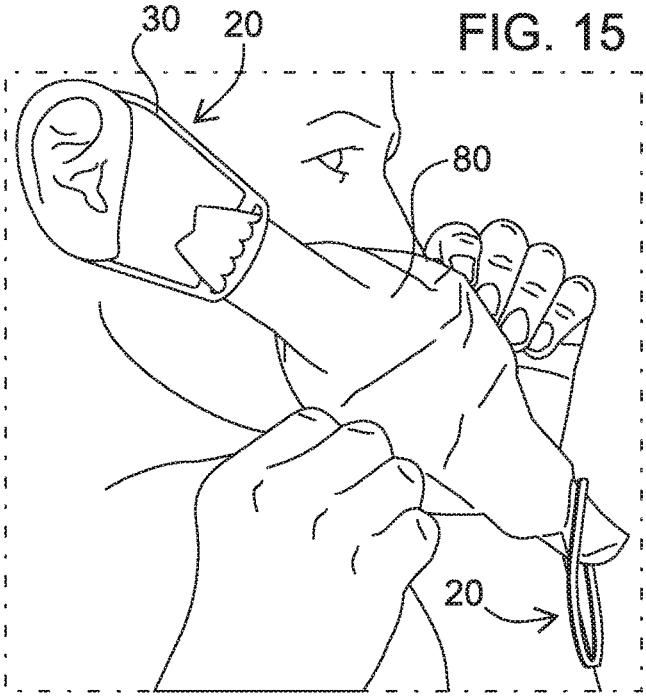
FIG. 15 is a side view of an embodiment of a face mask of the present invention being opened and positioned on the face of the user.
Figure 16:
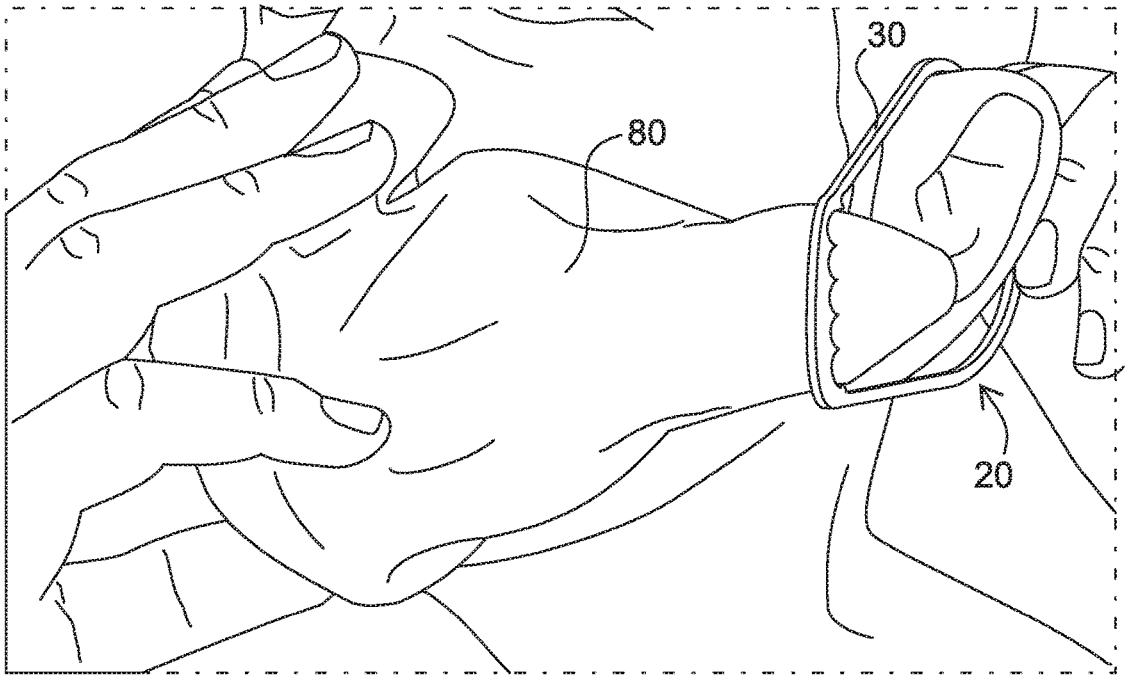
FIG. 16 is a side view of an embodiment of a face mask of the present invention being positioned on the second ear of a user.

As shown in FIG. 9, the face mask 300 may also include a lanyard 390 that is attached to the earpieces 320. The lanyard 390 would allow the user to quickly remove the face mask 300 from their face without dropping it and would allow the earpieces 320 to hang around the user's neck while replacing the protective sheet 380. The lanyard 390 may be an integral part of the earpieces 320, the lanyard 390 may be tied to the earpieces 320 or the lanyard 390 may attach to the earpieces 320 at an attachment point on each earpiece 320, such as the attachment points 28 discussed above.

To assemble the face mask 100, the protective sheet 80 is secured to each of the earpieces 20 through the trap 40 in each earpiece 20. Prior to securing the protective sheet 80 to each of the earpieces 20, the protective sheet 80 may be folded or scrunched for easier insertion into the trap 40. In order to secure the protective sheet 80 to each of the earpieces 20, one end of the protective sheet 80 is fed through the trap 40 of one earpiece 20 and the other end of the protective sheet 80 is fed through the trap 40 of the other earpiece 20. Optionally, in embodiments where the protective sheet 80 is folded, the user may insert additional layers into the protective sheet 80. Once the protective sheet 80 is secured to each earpiece 20, each earpiece 20 can be positioned around and secured to the user's ears. For example, in one method of applying the face mask 100 to the face of a user, the first earpiece 20 is looped over and positioned around one of the user's ears. The protective sheet 80 is then opened slightly near its center and positioned on the bridge of the user's nose and below the user's chin. The second earpiece 20 is then looped over and positioned around the user's other ear.

The fit of the face mask 100 can be tightened by pulling the end of the protective sheet 80 further through the trap 40 on one or both of the earpieces 20. The user can also adjust the position and coverage of the face mask 100 by manipulating the edges of the protective sheet 80. The user can create a more secure connection between the protective sheet 80 and the earpiece 20 by feeding the end of the protective sheet 80 through the trap 40 and then tucking any extra material from the protective sheet 80 back under the earpiece 20. Where the face mask 100 uses multiple linear traps 40, the end of the protective sheet 80 may be fed through the first linear trap 40 and then threaded back through the second linear trap 40 to create a more secure connection.

It is noted that the foregoing examples have been provided merely for the purpose of explanation and are in no way to be construed as limiting of the present invention. While the present invention has been described with reference to exemplary embodiments, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A face mask comprising:

a. a first earpiece having a trap and an ear loop;

b. a second earpiece having a trap and an ear loop;

wherein each trap is an aperture adjacent the respective ear loop and made through the entire thickness of the respective earpiece; and c. a protective sheet bunched and routed through the trap of the first earpiece and the trap of the second earpiece such that the protective sheet extends through the entire thickness of each earpiece, and wherein the protective sheet is removably connected to the first earpiece and the second earpiece, wherein the ear loop of the first earpiece is configured to surround a first ear of a user and the ear loop of the second earpiece is configured to surround a second ear of the user such that the protective sheet covers the user's nose and mouth.

2. The face mask of claim 1 wherein the protective sheet is a material selected from the list of cotton, wood pulp, nylon, microfiber, polyester, polypropylene, or a blend of these materials.

3. The face mask of claim 2 wherein the protective sheet is comprised of multiple layers.

4. The face mask of claim 3 wherein the multiple layers comprise an outer layer and an inner layer that each has a high fluid resistance and a high filtration central layer positioned between the outer layer and the inner layer.

5. The face mask of claim 4 wherein the outer layer and the inner layer are each meltblown and the central layer is spunbond.

6. The face mask of claim 3 wherein the multiple layers are connected to form a single protective sheet with sealed edges.

7. The face mask of claim 3 wherein the multiple layers comprise an outer layer of a first material that has a high fluid resistance and one or more inner layers made of a second material that possess a higher filtration rate and a lower fluid resistance.

8. The face mask of claim 1 wherein the first earpiece has a plurality of traps.

9. The face mask of claim 8 wherein the second earpiece has a plurality of traps.

10. The face mask of claim 1 wherein the first earpiece ear loop and the second earpiece ear loop are each closed ear loops.

11. The face mask of claim 1 wherein a lanyard connects to and extends between the first earpiece and the second earpiece.

12. The face mask of claim 1 wherein the first earpiece trap and the second earpiece trap are each linear traps.

13. The face mask of claim 1 wherein the first earpiece trap and the second earpiece trap are each enclosed traps.

14. The face mask of claim 1 wherein the protective sheet is a rectangular sheet.

15. The face mask of claim 1 wherein the protective sheet is hydro-entangled, spunbonded or melt blown.

16. A method for applying and wearing a face mask comprising:

a. providing a face mask comprising:

i. a first earpiece having a trap and an ear loop;

ii. a second earpiece having a trap and an ear loop;

wherein each trap is an aperture adjacent the respective ear loop and made through the entire thickness of the respective earpiece; and iii. a protective sheet bunched and routed through the trap of the first earpiece and the trap of the second earpiece such that the protective sheet extends through the entire thickness of each earpiece, and wherein the protective sheet is removably connected to the first earpiece and the second earpiece, wherein the ear loop of the first earpiece is positioned to surround a first ear of a user and the ear loop of the second earpiece is positioned to surround a second ear of the user such that the protective sheet covers a nose, mouth, and chin of the users;

b. securing the protective sheet in the trap of the first earpiece;

c. securing the protective sheet in the trap of the second earpiece;

d. positioning the first earpiece around the first ear of the user;

e. positioning the second earpiece around the second ear of the user;

f. adjusting the protective sheet to cover the user's nose and mouth; and g. tightening the protective sheet by pulling the protective sheet through the trap of the first earpiece, the trap of the second earpiece, or the trap of both the first and second earpiece such that the protective sheet is fitted across the user's face.

* * * * *